US011466351B2

(12) United States Patent
Bezencon et al.

(10) Patent No.: US 11,466,351 B2
(45) Date of Patent: Oct. 11, 2022

(54) **F* AND W TEMPER ALUMINUM ALLOY PRODUCTS AND METHODS OF MAKING THE SAME**

(71) Applicant: Novelis Inc., Atlanta, GA (US)

(72) Inventors: Cyrille Bezencon, Chermignon (CH); David Leyvraz, Sierre (CH); Aude Celine Despois, Grone (CH); Samuel R. Wagstaff, Marietta, GA (US)

(73) Assignee: Novells Inc., Atlanta, GA (US)

( * ) Notice: Subject to any disclaimer, the term of this patent is extended or adjusted under 35 U.S.C. 154(b) by 168 days.

(21) Appl. No.: 16/411,724

(22) Filed: May 14, 2019

(65) Prior Publication Data

US 2019/0352758 A1 Nov. 21, 2019

Related U.S. Application Data

(60) Provisional application No. 62/753,442, filed on Oct. 31, 2018, provisional application No. 62/671,677, filed on May 15, 2018.

(51) Int. Cl.
*C22F 1/04* (2006.01)
*C22F 1/00* (2006.01)

(52) U.S. Cl.
CPC ..... *C22F 1/04* (2013.01); *C22F 1/002* (2013.01)

(58) Field of Classification Search
CPC .... C22F 1/04; C22F 1/002; C22F 1/05; C22F 1/053; C22F 1/057; C22C 21/00; C22C 21/08; C22C 21/10; C22C 21/12
See application file for complete search history.

(56) References Cited

U.S. PATENT DOCUMENTS

2004/0118493 A1* 6/2004 Kimura ..... C22C 21/08 148/692
2004/0250928 A1 12/2004 Bull et al.
2005/0086784 A1* 4/2005 Li ..... C22C 21/08 29/421.1

(Continued)

FOREIGN PATENT DOCUMENTS

CN 102066596 5/2011
EP 2324137 1/2013

(Continued)

OTHER PUBLICATIONS

International Application No. PCT/US2019/032167 , "International Search Report and Written Opinion", dated Aug. 7, 2019, 11 pages.

(Continued)

*Primary Examiner* — Robert S Jones, Jr.
*Assistant Examiner* — Jiangtian Xu
(74) *Attorney, Agent, or Firm* — Kilpatrick Townsend & Stockton LLP

(57) ABSTRACT

Disclosed herein are aluminum alloy products and methods of making the aluminum alloy products. Specifically, disclosed herein is an aluminum alloy provided in a temper achieved by rapidly quenching the aluminum alloy product after hot rolling. The aluminum alloys provided in the tempers described herein allow an end user to further process the aluminum alloys using less time and requiring less energy.

15 Claims, 5 Drawing Sheets

(56) References Cited

U.S. PATENT DOCUMENTS

| | | | | |
|---|---|---|---|---|
| 2008/0041501 | A1* | 2/2008 | Platek | C22C 21/06 420/534 |
| 2012/0222783 | A1 | 9/2012 | Brinkman et al. | |
| 2014/0000768 | A1* | 1/2014 | Sawtell | C22F 1/05 148/551 |
| 2016/0002761 | A1 | 1/2016 | De Smet | |
| 2016/0068939 | A1 | 3/2016 | Brinkman et al. | |
| 2017/0175240 | A1 | 6/2017 | Wen et al. | |
| 2017/0198376 | A1 | 7/2017 | Newman et al. | |
| 2018/0117650 | A1 | 5/2018 | Felberbaum et al. | |

FOREIGN PATENT DOCUMENTS

| | | | |
|---|---|---|---|
| EP | 3117019 | | 1/2017 |
| EP | 2499271 | | 1/2018 |
| JP | 5306440 | | 11/1993 |
| JP | H05306440 | A * | 11/1993 |
| KR | 20150023006 | | 3/2015 |
| WO | 2018080707 | | 5/2018 |

OTHER PUBLICATIONS

Chinese Application No. 201980032392.0, Office Action, dated Jun. 22, 2021, 20 pages.

"Aluminum Handbook", General Incorporated Association, Japan Aluminium Association, Standard Committee, 7th Edition, Jan. 31, 2007, pp. 5-14.

Japanese Application No. 2020-560267 , Office Action, dated Nov. 30, 2021, 20 pages.

Korean Application No. 10-2020-7030919 , Office Action, dated Feb. 10, 2022, 11 pages.

Canadian Application No. 3,093,126 , Office Action, dated Sep. 22, 2021, 3 pages.

Canadian Application No. 3,093,126, Office Action, dated May 11, 2022, 3 pages.

Chinese Application No. 201980032392.0, Office Action, dated Mar. 22, 2022, 10 pages.

European Application No. 19727246.1, Office Action, dated Apr. 8, 2022, 4 pages.

Chinese Application No. 201980032392.0 , Office Action, dated Jun. 22, 2022, 8 pages.

Japanese Application No. 2020-560267 , Office Action, dated Jun. 14, 2022, 22 pages.

ASTM:ASTM Designation: B947-06 Standard Practice for Hot Rolling Mill Solution Heat Treatment for Aluminum Alloy Plate:, 2011 Annual Book of ASTM Standards, Section Two, Nonferrous Metal Products, vol. 02.02 Aluminum and Magnesium Alloys; ASTM International, pp. 696-699, 2011.†

Shuey, et al, "Prediction of Time for Solution Heat Treat", Aluminum Alloys: Their Physical and Mechanical Properties—Proceedings ICAA5—Part 2, pp. 735-740, Transtec Publication, 1996.†

ASM: ASM Handbook; vol. 4: Heat Treating, Heat Treatment of Aluminum Alloys, p. 851, 1991.†

* cited by examiner
† cited by third party

F* AND W TEMPER ALUMINUM ALLOY PRODUCTS AND METHODS OF MAKING THE SAME

CROSS-REFERENCE TO RELATED APPLICATIONS

This application claims the benefit of U.S. Provisional Application Nos. 62/671,677, filed May 15, 2018, and 62/753,442, filed Oct. 31, 2018, which are incorporated herein by reference in their entireties.

FIELD

The present disclosure relates to aluminum alloys, products prepared from the aluminum alloys, and methods for making the same.

BACKGROUND

Aluminum alloys for use in transportation (e.g., automotive) and electronics applications should exhibit high strength and good forming properties. In some cases, relatively low formability of the aluminum alloys can lead to difficulties in obtaining desirable part designs. Low formability can also cause product failure due to fracture or wrinkling. Hot forming of aluminum alloy sheets is used in the automotive industry to overcome these challenges since the aluminum alloys exhibit increased formability at elevated temperatures. Generally, hot forming is the process of deforming metal at an elevated temperature. Hot forming can maximize the metal's malleability but can create its own challenges. For example, heating can negatively affect mechanical properties of an aluminum alloy product, as heated aluminum alloy products can exhibit decreased strength during forming operations and the decreased strength characteristics may persist after cooling of the aluminum alloy product. Heating of aluminum alloy products also can lead to increased thinning of aluminum alloy parts during forming operations. For example, heating of an aluminum alloy facilitates precipitation and dissolution processes within the aluminum alloy, which may lead to recrystallization and grain growth that may change the aluminum alloy's structure and negatively affect its mechanical properties.

SUMMARY

Covered embodiments of the invention are defined by the claims below, not this summary. This summary is a high-level overview of various aspects of the disclosure and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this disclosure, any or all drawings, and each claim.

Disclosed herein are methods of producing an aluminum alloy product comprising casting a heat treatable aluminum alloy (e.g., a 2xxx series aluminum alloy, a 6xxx series aluminum alloy, a 7xxx series aluminum alloy, or an 8xxx series aluminum alloy) to form a cast aluminum alloy, homogenizing the cast aluminum alloy, hot rolling the cast aluminum alloy to produce a rolled product, quenching the rolled product at a quench rate of from about 10° C./s to about 1000° C./s, and coiling the rolled product to provide an aluminum alloy product. In some cases, the quench rate is from about 200° C./s to about 1000° C./s (e.g., from about 500° C./s to about 1000° C./s). The quenching can be performed immediately after hot rolling the cast aluminum alloy. The quenching can be performed using air, water, oil, a water-oil emulsion, or any combination thereof. The aluminum alloy product can be a monolithic aluminum alloy product or a clad aluminum alloy product.

The method of producing an aluminum alloy product can further comprise cold rolling the rolled product after the quenching. Optionally, an annealing step is not performed. Optionally, the method can further comprise heating the aluminum alloy product to a temperature of from about 400° C. to about 580° C. and maintaining the aluminum alloy product at the temperature for about 5 minutes or less (e.g., about 3 minutes or less, about 1 minute or less, or about 30 seconds or less). In some cases, a cycle time for performing the heating and the maintaining is at least about 20% shorter than a cycle time for an aluminum alloy product prepared without quenching the rolled product after the hot rolling step (e.g., at least about 30% shorter, at least about 40% shorter, or at least about 50% shorter than a cycle time for an aluminum alloy product prepared without quenching the rolled product after the hot rolling step). The method can further comprise forming the aluminum alloy product after the maintaining at a temperature of from about 400° C. to about 580° C.

Further described herein is an aluminum alloy hot band prepared according to a method comprising casting a heat treatable aluminum alloy to form a cast aluminum alloy, homogenizing the cast aluminum alloy, hot rolling the cast aluminum alloy to produce a rolled product, quenching the rolled product at a quench rate of from about 10° C./s to about 1000° C./s, and coiling the rolled product to provide an aluminum alloy hot band. Optionally, the aluminum alloy hot band is quenched immediately after the hot rolling.

Also described herein is a method of producing an aluminum alloy product comprising casting a heat treatable aluminum alloy to form a cast aluminum alloy; optionally heating the cast aluminum alloy; hot rolling the cast aluminum alloy to produce a rolled product, wherein the hot rolling is performed in a hot rolling mill comprising a plurality of stands and wherein each stand is followed by a quenching system; quenching the rolled product upon exit from at least one stand in the plurality of stands in the hot rolling step at a quench rate of from about 10° C./s to about 1000° C./s; optionally cold rolling the rolled product; and coiling the rolled product to provide an aluminum alloy product.

Also described herein is an aluminum alloy product prepared according to the method described herein, wherein the aluminum alloy product comprises a sheet.

Further aspects, objects, and advantages will become apparent upon consideration of the detailed description of non-limiting examples that follow.

DETAILED DESCRIPTION

Figure 1:
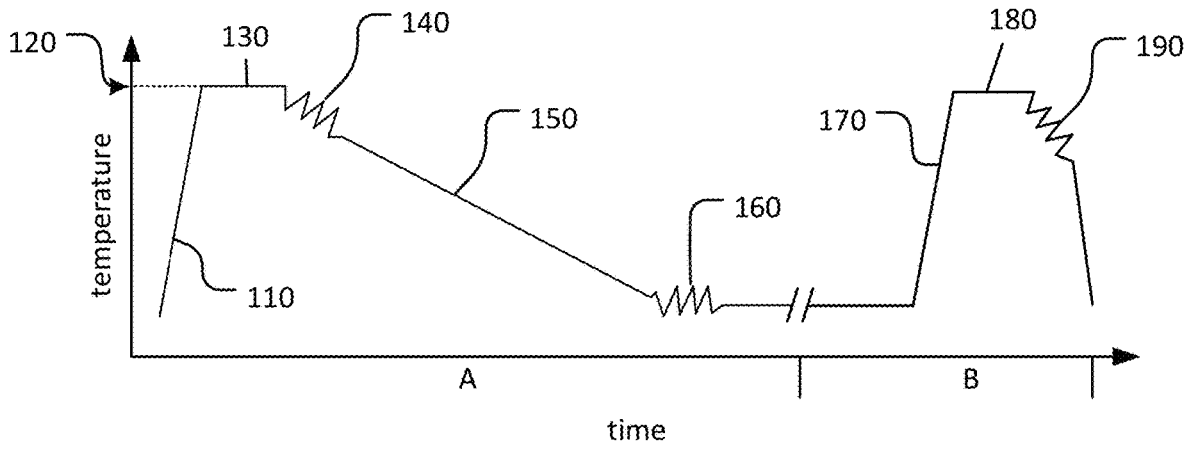
FIG. 1 is a graph showing thermal histories of a comparative aluminum alloy processing method described herein.

Described herein are methods for processing aluminum alloys, and more specifically, heat treatable aluminum alloys, that improve the time and cost efficiencies of forming such alloys into high strength and highly formable products. The methods include a quench technique that improves properties of aluminum alloy products upon subjecting the products to downstream heat processing (e.g., a paint bake process). The quench technique is performed on a cast aluminum alloy material after hot rolling and while on the hot mill to produce a solutionized aluminum alloy material. Such resulting material is referred to as being in an F* temper. Alternatively, the quench technique is initiated when the cast aluminum alloy material is at a temperature greater than a solutionizing temperature of the cast aluminum alloy material and is performed rapidly. Such resulting material is referred to as being in a W temper. The aluminum alloy product in the F* or W temper can require less energy to hot form when compared to conventional methods. For example, an end user hot forming the aluminum alloy product in the F* or W temper can use from about 5% to about 20% less energy to hot form the aluminum alloy product in the F* or W temper. In some cases, heating the aluminum alloy product to a hot forming temperature can require less time and lower costs, as the aluminum alloy can be heated to the hot forming temperature and not to a temperature greater than the hot forming temperature. As such, subsequent cooling to the hot forming temperature of the aluminum alloy product is not required. In addition, because the F* or W temper material is already solutionized, the method does not require heating the aluminum alloy product at the hot forming temperature for extended time periods (e.g., 15 minutes or more) to further solutionize the product, as required by methods that do not deliver F* or W temper material. The methods described herein thus produce superior F* or W temper material that can be efficiently hot formed into the desired shape.

Definitions and Descriptions

As used herein, the terms "invention," "the invention," "this invention," and "the present invention" are intended to refer broadly to all of the subject matter of this patent application and the claims below. Statements containing these terms should be understood not to limit the subject matter described herein or to limit the meaning or scope of the patent claims below.

As used herein, the meaning of "a," "an," and "the" includes singular and plural references unless the context clearly dictates otherwise.

In this description, reference is made to alloys identified by AA numbers and other related designations, such as "7xxx" and "series." For an understanding of the number designation system most commonly used in naming and identifying aluminum and its alloys, see "International Alloy Designations and Chemical Composition Limits for Wrought Aluminum and Wrought Aluminum Alloys" or "Registration Record of Aluminum Association Alloy Designations and Chemical Compositions Limits for Aluminum Alloys in the Form of Castings and Ingot," both published by The Aluminum Association.

Reference is made in this application to alloy temper or condition. For an understanding of the alloy temper descriptions most commonly used, see "American National Standards (ANSI) H35 on Alloy and Temper Designation Systems." An F condition or temper refers to an aluminum alloy as fabricated. As used herein, an F* temper refers to a heat treatable aluminum alloy that is hot worked (e.g., hot rolled, extruded, forged, or drawn) and immediately quenched while still in a solutionized state, and optionally cold worked. A W condition or temper refers to an aluminum alloy solution heat treated at a temperature greater than a solvus temperature of the aluminum alloy and then quenched. An O condition or temper refers to an aluminum alloy after annealing. An Hxx condition or temper, also referred to herein as an H temper, refers to a non-heat treatable aluminum alloy after cold rolling with or without thermal treatment (e.g., annealing). Suitable H tempers include HX1, HX2, HX3 HX4, HX5, HX6, HX7, HX8, or HX9 tempers. A T1 condition or temper refers to an aluminum alloy cooled from hot working and naturally aged (e.g., at room temperature). A T2 condition or temper refers to an aluminum alloy cooled from hot working, cold worked and naturally aged. A T3 condition or temper refers to an aluminum alloy solution heat treated, cold worked, and naturally aged. A T4 condition or temper refers to an aluminum alloy solution heat treated and naturally aged. A T5 condition or temper refers to an aluminum alloy cooled from hot working and artificially aged (at elevated temperatures). A T6 condition or temper refers to an aluminum alloy solution heat treated and artificially aged. A T7 condition or temper refers to an aluminum alloy solution heat treated and artificially overaged. A T8x condition or temper refers to an aluminum alloy solution heat treated, cold worked, and artificially aged. A T9 condition or temper refers to an aluminum alloy solution heat treated, artificially aged, and cold worked. A W condition or temper refers to an aluminum alloy after solution heat treatment.

As used herein, a plate generally has a thickness of greater than about 15 mm. For example, a plate may refer to an aluminum product having a thickness of greater than about 15 mm, greater than about 20 mm, greater than about 25 mm, greater than about 30 mm, greater than about 35 mm, greater than about 40 mm, greater than about 45 mm, greater than about 50 mm, or greater than about 100 mm.

As used herein, a shate (also referred to as a sheet plate) generally has a thickness of from about 4 mm to about 15 mm. For example, a shate may have a thickness of about 4 mm, about 5 mm, about 6 mm, about 7 mm, about 8 mm, about 9 mm, about 10 mm, about 11 mm, about 12 mm, about 13 mm, about 14 mm, or about 15 mm.

As used herein, a sheet generally refers to an aluminum product having a thickness of less than about 4 mm. For example, a sheet may have a thickness of less than about 4 mm, less than about 3 mm, less than about 2 mm, less than about 1 mm, less than about 0.5 mm, or less than about 0.3 mm (e.g., about 0.2 mm).

As used herein, the meaning of "room temperature" can include a temperature of from about 15° C. to about 30° C., for example about 15° C., about 16° C., about 17° C., about 18° C., about 19° C., about 20° C., about 21° C., about 22° C., about 23° C., about 24° C., about 25° C., about 26° C., about 27° C., about 28° C., about 29° C., or about 30° C.

All ranges disclosed herein are to be understood to encompass any and all subranges subsumed therein. For example, a stated range of "1 to 10" should be considered to include any and all subranges between (and inclusive of) the minimum value of 1 and the maximum value of 10; that is, all subranges beginning with a minimum value of 1 or more, e.g. 1 to 6.1, and ending with a maximum value of 10 or less, e.g., 5.5 to 10.

As used herein, terms such as "cast metal product," "cast product," "cast aluminum alloy product," and the like are interchangeable and refer to a product produced by direct chill casting (including direct chill co-casting) or semi-continuous casting, continuous casting (including, for example, by use of a twin belt caster, a twin roll caster, a twin block caster, or any other continuous caster), electromagnetic casting, hot top casting, or any other casting method.

Methods of Making

Disclosed herein are methods of making aluminum alloy products in an F* or W temper. The F* temper is achieved by rapidly quenching the aluminum alloy product after hot rolling. The W temper is achieved by rapidly quenching the aluminum alloy product after or during hot rolling while the aluminum alloy product is at a temperature greater than the solutionizing temperature. As described above, the aluminum alloy products provided in the F* or W temper allow an end user to further process the aluminum alloys (e.g., form at an elevated temperature) using less time and requiring less energy than that of a comparative method. In certain examples, a comparative method of hot forming an aluminum alloy can include heating the aluminum alloy to a temperature of from about 460° C. to about 480° C. and maintaining the temperature for a time period of from about 5 minutes to about 15 minutes to solutionize the aluminum alloy. After heating, the aluminum alloy can then be cooled to a hot forming temperature of from about 440° C. to about 480° C. In some non-limiting examples, employing the exemplary quenching after hot rolling and providing the aluminum alloy product in an F* or W temper can eliminate any need to heat the aluminum alloy to a temperature greater than the hot forming temperature, soak the aluminum alloy at the temperature greater than the hot forming temperature, or cool the aluminum alloy to the hot forming temperature.

Suitable aluminum alloys for use in the methods described herein include heat treatable aluminum alloys. For example, the aluminum alloys for use in the methods described herein can include 2xxx series aluminum alloys, 6xxx series aluminum alloys, 7xxx series aluminum alloys, and/or 8xxx series aluminum alloys.

Optionally, the aluminum alloy can be a 2xxx series aluminum alloy according to one of the following aluminum alloy designations: AA2001, A2002, AA2004, AA2005, AA2006, AA2007, AA2007A, AA2007B, AA2008, AA2009, AA2010, AA2011, AA2011A, AA2111, AA2111A, AA2111B, AA2012, AA2013, AA2014, AA2014A, AA2214, AA2015, AA2016, AA2017, AA2017A, AA2117, AA2018, AA2218, AA2618, AA2618A, AA2219, AA2319, AA2419, AA2519, AA2021, AA2022, AA2023, AA2024, AA2024A, AA2124, AA2224, AA2224A, AA2324, AA2424, AA2524, AA2624, AA2724, AA2824, AA2025, AA2026, AA2027, AA2028, AA2028A, AA2028B, AA2028C, AA2029, AA2030, AA2031, AA2032, AA2034, AA2036, AA2037, AA2038, AA2039, AA2139, AA2040, AA2041, AA2044, AA2045, AA2050, AA2055, AA2056, AA2060, AA2065, AA2070, AA2076, AA2090, AA2091, AA2094, AA2095, AA2195, AA2295, AA2196, AA2296, AA2097, AA2197, AA2297, AA2397, AA2098, AA2198, AA2099, or AA2199.

Optionally, the aluminum alloy can be a 6xxx series aluminum alloy according to one of the following aluminum alloy designations: AA6101, AA6101A, AA6101B, AA6201, AA6201A, AA6401, AA6501, AA6002, AA6003, AA6103, AA6005, AA6005A, AA6005B, AA6005C, AA6105, AA6205, AA6305, AA6006, AA6106, AA6206, AA6306, AA6008, AA6009, AA6010, AA6110, AA6110A, AA6011, AA6111, AA6012, AA6012A, AA6013, AA6113, AA6014, AA6015, AA6016, AA6016A, AA6116, AA6018, AA6019, AA6020, AA6021, AA6022, AA6023, AA6024, AA6025, AA6026, AA6027, AA6028, AA6031, AA6032, AA6033, AA6040, AA6041, AA6042, AA6043, AA6151, AA6351, AA6351A, AA6451, AA6951, AA6053, AA6055, AA6056, AA6156, AA6060, AA6160, AA6260, AA6360, AA6460, AA6460B, AA6560, AA6660, AA6061, AA6061A, AA6261, AA6361, AA6162, AA6262, AA6262A, AA6063, AA6063A, AA6463, AA6463A, AA6763, A6963, AA6064, AA6064A, AA6065, AA6066, AA6068, AA6069, AA6070, AA6081, AA6181, AA6181A, AA6082, AA6082A, AA6182, AA6091, or AA6092.

Optionally, the aluminum alloy can be a 7xxx series aluminum alloy according to one of the following aluminum alloy designations: AA7019, AA7020, AA7021, AA7039, AA7072, AA7075, AA7085, AA7108, AA7108A, AA7015, AA7017, AA7018, AA7019A, AA7024, AA7025, AA7028, AA7030, AA7031, AA7033, AA7035, AA7035A, AA7046, AA7046A, AA7003, AA7004, AA7005, AA7009, AA7010, AA7011, AA7012, AA7014, AA7016, AA7116, AA7122, AA7023, AA7026, AA7029, AA7129, AA7229, AA7032, AA7033, AA7034, AA7036, AA7136, AA7037, AA7040, AA7140, AA7041, AA7049, AA7049A, AA7149, AA7249, AA7349, AA7449, AA7050, AA7050A, AA7150, AA7250, AA7055, AA7155, AA7255, AA7056, AA7060, AA7064, AA7065, AA7068, AA7168, AA7175, AA7475, AA7076, AA7178, AA7278, AA7278A, AA7081, AA7181, AA7185, AA7090, AA7093, AA7095, or AA7099.

Optionally, the aluminum alloy can be an 8xxx series aluminum alloy according to one of the following aluminum alloy designations: AA8024, AA8090, AA8091, or AA8093.

In some examples, the alloys for use in the methods described herein are monolithic alloys. In other examples, the alloys for use in the methods described herein are clad aluminum alloy products having a core layer and one or two cladding layers. The core layer can be prepared from a 2xxx series aluminum alloy, a 6xxx series aluminum alloy, or a 7xxx series aluminum alloy as described herein. The cladding layers can each independently be prepared from a 2xxx series aluminum alloy, a 6xxx series aluminum alloy, a 7xxx series aluminum alloy, or an 8xxx series aluminum alloy.

Casting

The alloys described herein can be cast using a casting method as known to those of skill in the art. For example, the casting process can include a direct chill (DC) casting process. Optionally, DC cast aluminum alloy products (e.g., ingots) can be scalped before subsequent processing. Optionally, the casting process can include a continuous casting (CC) process. The cast aluminum alloy products can then be subjected to further processing steps. In one non-limiting example, the processing method includes homogenizing, hot rolling, and quenching. In some cases, the processing steps further include cold rolling, if desired. Optionally, an annealing step is not performed in the method described herein.

A. Processing a DC Cast Aluminum Alloy

Homogenization

The homogenization step can include heating a cast aluminum alloy product, such as an ingot, prepared from an alloy composition described herein to attain a peak metal temperature (PMT) of about, or at least about, 500° C. (e.g., at least about 520° C., at least about 530° C., at least about 540° C., at least about 550° C., at least about 560° C., at least about 570° C., or at least about 580° C.). For example, the ingot can be heated to a temperature of from about 520° C. to about 580° C., from about 530° C. to about 575° C., from about 535° C. to about 570° C., from about 540° C. to about 565° C., from about 545° C. to about 560° C., from about 530° C. to about 560° C., or from about 550° C. to about 580° C. In some cases, the heating rate to the PMT can be about 100° C./hour or less, about 75° C./hour or less, about 50° C./hour or less, about 40° C./hour or less, about 30° C./hour or less, about 25° C./hour or less, about 20° C./hour or less, or about 15° C./hour or less. In other cases, the heating rate to the PMT can be from about 10° C./min to about 100° C./min (e.g., from about 10° C./min to about 90° C./min, from about 10° C./min to about 70° C./min, from about 10° C./min to about 60° C./min, from about 20° C./min to about 90° C./min, from about 30° C./min to about 80° C./min, from about 40° C./min to about 70° C./min, or from about 50° C./min to about 60° C./min).

The cast aluminum alloy product is then allowed to soak (i.e., held at the indicated temperature) for a period of time. According to one non-limiting example, the cast aluminum alloy product is allowed to soak for up to about 18 hours (e.g., from about 30 minutes to about 18 hours, inclusively). For example, the cast aluminum alloy product can be soaked at a temperature of at least about 500° C. for about 30 minutes, about 1 hour, about 2 hours, about 3 hours, about 4 hours, about 5 hours, about 6 hours, about 7 hours, about 8 hours, about 9 hours, about 10 hours, about 11 hours, about 12 hours, about 13 hours, about 14 hours, about 15 hours, about 16 hours, about 17 hours, or about 18 hours, or anywhere in between.

Hot Rolling

Following the homogenization step, a hot rolling step is performed. In certain cases, the cast aluminum alloy product is hot rolled in a hot mill with a hot mill entry temperature of from about 370° C. to about 540° C. The hot mill entry temperature can be, for example, about 370° C., about 375° C., about 380° C., about 385° C., about 390° C., about 395° C., about 400° C., about 405° C., about 410° C., about 415° C., about 420° C., about 425° C., about 430° C., about 435° C., about 440° C., about 445° C., about 450° C., about 455° C., about 460° C., about 465° C., about 470° C., about 475° C., about 480° C., about 485° C., about 490° C., about 495° C., about 500° C., about 505° C., about 510° C., about 515° C., about 520° C., about 525° C., about 530° C., about 535° C., or about 540° C. In certain cases, the hot roll exit temperature can range from about 250° C. to about 380° C. (e.g., from about 330° C. to about 370° C.). For example, the hot roll exit temperature can be about 255° C., about 260° C., about 265° C., about 270° C., about 275° C., about 280° C., about 285° C., about 290° C., about 295° C., about 300° C., about 305° C., about 310° C., about 315° C., about 320° C., about 325° C., about 330° C., about 335° C., about 340° C., about 345° C., about 350° C., about 355° C., about 360° C., about 365° C., about 370° C., about 375° C., or about 380° C. In some non-limiting examples, hot rolling provides a rolled product (e.g., an aluminum alloy hot band).

In certain cases, the aluminum alloy hot band can have a thickness (i.e., gauge) of from about 1 mm to about 15 mm (e.g., from about 4 mm to about 12 mm). For example, the aluminum alloy hot band can be provided having an about 1 mm gauge, about 2 mm gauge, about 3 mm gauge, about 4 mm gauge, about 5 mm gauge, about 6 mm gauge, about 7 mm gauge, about 8 mm gauge, about 9 mm gauge, about 10 mm gauge, about 11 mm gauge, about 12 mm gauge, about 13 mm gauge, about 14 mm gauge, about 15 mm gauge, or anywhere in between. In certain cases, the aluminum alloy hot band can have a gauge greater than about 15 mm thick.

Quenching after Hot Rolling

After the hot rolling step, a quenching step is performed. The term "quenching," as used herein, can include rapidly reducing a temperature of an aluminum alloy product (e.g., an aluminum alloy hot band). In the quenching step, the aluminum alloy product is quenched with a liquid (e.g., water, oil, or a water-oil emulsion) and/or gas (e.g., air) or another selected quench medium. The quenching step can be performed before a final hot rolling pass or immediately after the final hot rolling pass (e.g., upon the aluminum alloy hot band exiting the hot mill). As described above, performing the quenching step in this manner can provide an aluminum alloy product having unexpected properties. In addition, quenching the aluminum alloy hot band upon exiting the hot mill can provide an aluminum alloy product requiring less energy to be prepared for subsequent forming at an elevated temperature, as compared to methods that do not employ a step of quenching the aluminum alloy hot band upon exiting the hot mill.

In some non-limiting examples, the quenching can be performed at a rate of from about 10° C./second (° C./s) to about 1000° C./s (e.g., from about 20° C./s to about 1000° C./s, from about 50° C./s to about 900° C./s, from about 100° C./s to about 800° C./s, from about 200° C./s to about 700° C./s, from about 250° C./s to about 600° C./s, or from about 300° C./s to about 550° C./s). For example, quenching can be performed at a rate of about 10° C./s, about 15° C./s, about 20° C./s, about 25° C./s, about 30° C./s, about 35° C./s, about 40° C./s, about 45° C./s, about 50° C./s, about 55° C./s, about 60° C./s, about 65° C./s, about 70° C./s, about 75° C./s, about 80° C./s, about 85° C./s, about 90° C./s, about 95° C./s, about 100° C./s, about 150° C./s, about 200° C./s, about 250° C./s, about 300° C./s, about 350° C./s, about 400° C./s, about 450° C./s, about 500° C./s, about 550° C./s, about 600° C./s, about 650° C./s, about 700° C./s, about 750° C./s, about 800° C./s, about 850° C./s, about 900° C./s, about 950° C./s, about 1000° C./s, or anywhere in between. In some aspects, the aluminum alloy hot band can be quenched to reduce the temperature of the aluminum alloy product to a temperature of from about 250° C. to about room temperature. For example, the aluminum alloy hot band can be quenched to a temperature of about 250° C., about 240° C., about 230° C., about 220° C., about 210° C., about 200° C., about 190° C., about 180° C., about 170° C., about 160° C., about 150° C., about 140° C., about 130° C., about 120° C., about 110° C., about 100° C., about 90° C., about 80° C., about 70° C., about 60° C., about 50° C., about 40° C., about 30° C., about 20° C., about 15° C., or anywhere in between.

Optional Processing Step: Cold Rolling Step

In certain aspects, the aluminum alloy hot band can be subjected to further processing after the quenching after the hot rolling step and before any subsequent steps (e.g., before a coiling step and/or before any steps performed by an end user, including forming, coating, paint baking, and the like). Further processing steps can include a cold rolling step to further reduce the gauge of the aluminum alloy hot band, or any other suitable cold working step to reduce the gauge of the aluminum alloy hot band to provide a thin gauge aluminum alloy product (e.g., from about 0.2 mm to about 4.0 mm). For example, the thin gauge aluminum alloy product can be a sheet or a shate having a gauge of about 0.2 mm, about 0.3 mm, about 0.4 mm, about 0.5 mm, about 0.6 mm, about 0.7 mm, about 0.8 mm, about 0.9 mm, about 1.0 mm, about 1.5 mm, about 2.0 mm, about 2.5 mm, about 3.0 mm, about 3.5 mm, or about 4.0 mm.

Final Gauge and Coiling

The aluminum alloy products described herein can have any suitable gauge. As described above, the products can be cast and processed into various sizes and thicknesses, such as sheet (e.g., from approximately 0.20 mm to less than 4.0 mm), shate (e.g., from approximately 4.0 mm to 15.0 mm), or plate (e.g., greater than approximately 15.0 mm), although other thicknesses and ranges can be used as well. In some examples, the aluminum alloy products described herein can be provided and delivered to a customer or an end user in an intermediate gauge (e.g., a gauge that will be further reduced by the customer or end user, as desired). In some examples, the aluminum alloy products described herein can be provided and delivered to a customer or an end user in a final gauge. The aluminum alloy product can be gathered at a terminal point of a production line to form an aluminum alloy coil.

B. Processing a Continuously Cast Aluminum Alloy

Heating after Casting

After exiting a continuous caster (e.g., a twin belt caster, a twin roll caster, a twin block caster, or any other continuous caster), the cast aluminum alloy product can be fed into a furnace. In some cases, feeding the cast aluminum alloy product into a furnace can equilibrate a temperature across a width of the cast aluminum alloy product. For example, when exiting the continuous caster, the cast aluminum alloy product can have a first temperature at a center of the cast aluminum alloy product and a second temperature at one or more edges of the cast aluminum alloy product. Further, the cast aluminum alloy product can have a temperature gradient extending from the center of the cast aluminum alloy product to at least one edge of the cast aluminum alloy product. In some cases, upon exiting the continuous caster, the cast aluminum alloy product can have any thermal profile including a plurality of temperatures across the width of the cast aluminum alloy product. Thus, feeding the cast aluminum alloy product into a furnace after exiting the continuous caster can equilibrate the thermal profile of the cast aluminum alloy product.

Feeding the cast aluminum alloy product into a furnace heats the cast aluminum alloy product. Heating the cast aluminum alloy product can prepare the cast aluminum alloy product for hot rolling. In some cases, heating the cast aluminum alloy product for hot rolling includes heating the cast aluminum alloy product to a temperature of from about 370° C. to about 540° C. The hot mill entry temperature can be, for example, about 370° C., about 375° C., about 380° C., about 385° C., about 390° C., about 395° C., about 400° C., about 405° C., about 410° C., about 415° C., about 420° C., about 425° C., about 430° C., about 435° C., about 440° C., about 445° C., about 450° C., about 455° C., about 460° C., about 465° C., about 470° C., about 475° C., about 480° C., about 485° C., about 490° C., about 495° C., about 500° C., about 505° C., about 510° C., about 515° C., about 520° C., about 525° C., about 530° C., about 535° C., or about 540° C.

Optionally, heating the cast aluminum alloy product can solutionize the cast aluminum alloy product. Solutionizing the cast aluminum alloy product can be performed by heating the cast aluminum alloy product to a PMT of about, or at least about, 450° C. (e.g., at least about 460° C., at least about 470° C., at least about 480° C., at least about 490° C., at least about 500° C., at least about 510° C., at least about 520° C., at least about 530° C., at least about 540° C., at least about 550° C., at least about 560° C., at least about 570° C., or at least about 580° C.). For example, the cast aluminum alloy product can be heated to a temperature of from about 520° C. to about 580° C., from about 530° C. to about 575° C., from about 535° C. to about 570° C., from about 540° C. to about 565° C., from about 545° C. to about 560° C., from about 530° C. to about 560° C., or from about 550° C. to about 580° C.

The heated cast aluminum alloy product can optionally be quenched after exiting the furnace and hot rolled to a final gauge or an intermediate gauge, as described above. In some cases, a hot rolling mill can have multiple stands, with optional quenching systems downstream of each stand, including after a final stand. The quenching after each stand in the hot rolling mill (e.g., upon exit from at least one stand in the plurality of stands in the hot rolling step) can be performed at a quench rate of from about 10° C./second (° C./s) to about 1000° C./s (e.g., from about 20° C./s to about 1000° C./s, from about 50° C./s to about 900° C./s, from about 100° C./s to about 800° C./s, from about 200° C./s to about 700° C./s, from about 250° C./s to about 600° C./s, or from about 300° C./s to about 550° C./s). For example, quenching can be performed at a rate of about 10° C./s, about 15° C./s, about 20° C./s, about 25° C./s, about 30° C./s, about 35° C./s, about 40° C./s, about 45° C./s, about 50° C./s, about 55° C./s, about 60° C./s, about 65° C./s, about 70° C./s, about 75° C./s, about 80° C./s, about 85° C./s, about 90° C./s, about 95° C./s, about 100° C./s, about 150° C./s, about 200° C./s, about 250° C./s, about 300° C./s, about 350° C./s, about 400° C./s, about 450° C./s, about 500° C./s, about 550° C./s, about 600° C./s, about 650° C./s, about 700° C./s, about 750° C./s, about 800° C./s, about 850° C./s, about 900° C./s, about 950° C./s, about 1000° C./s, or anywhere in between. In some aspects, the aluminum alloy product can be quenched to reduce the temperature of the aluminum alloy product to a temperature of from about 300° C. to about room temperature. For example, the aluminum alloy product can be quenched to a temperature of about 300° C., about 290° C., about 280° C., about 270° C., about 260° C., about 250° C., about 240° C., about 230° C., about 220° C., about 210° C., about 200° C., about 190° C., about 180° C., about 170° C., about 160° C., about 150° C., about 140° C., about 130° C., about 120° C., about 110° C., about 100° C., about 90° C., about 80° C., about 70° C., about 60° C., about 50° C., about 40° C., about 30° C., about 20° C., about 15° C., or anywhere in between. In some non-limiting examples, hot rolling provides a rolled product (e.g., an aluminum alloy hot band).

Optional Processing Step: Cold Rolling Step

In certain aspects, the aluminum alloy hot band can be subjected to further processing after the quenching after the hot rolling step and before any subsequent steps (e.g., before a coiling step and/or before any steps performed by an end user, including forming, coating, paint baking, and the like). Further processing steps can include a cold rolling step to further reduce the gauge of the aluminum alloy hot band, or any other suitable cold working step to reduce the gauge of the aluminum alloy hot band to provide a thin gauge aluminum alloy product (e.g., from about 0.2 mm to about 4 mm). For example, the thin gauge aluminum alloy product can be a sheet or a shate having a gauge of about 0.2 mm, about 0.3 mm, about 0.4 mm, about 0.5 mm, about 0.6 mm, about 0.7 mm, about 0.8 mm, about 0.9 mm, about 1 mm, about 1.5 mm, about 2 mm, about 2.5 mm, about 3 mm, about 3.5 mm, or about 4 mm. In some cases, the cold rolling step can reduce the gauge of the aluminum alloy hot band to provide an intermediate gauge aluminum alloy product (e.g., from greater than about 4 mm to about 15 mm). For example, the intermediate gauge aluminum alloy product can be a shate having a gauge of greater than about 4 mm, about 5 mm, about 6 mm, about 7 mm, about 8 mm, about 9 mm, about 10 mm, about 11 mm, about 12 mm, about 13 mm, about 14 mm, or about 15 mm. In some cases, multiple cold working steps can be performed to reduce the gauge of the aluminum alloy. For example, a first cold rolling step can be performed to provide an intermediate gauge aluminum alloy product, and a second cold rolling step can be performed to further reduce the gauge of the intermediate gauge aluminum alloy product to provide, in some cases, a second intermediate gauge aluminum alloy product and/or a final gauge aluminum alloy product.

Properties of the Rolled Aluminum Alloys

As described herein, quenching the aluminum alloy after hot rolling in the case of the DC cast alloys, or quenching during hot rolling in the case of the CC alloys, provides an aluminum alloy having a microstructure that is optimized for a rapid heating step before a forming process (e.g., hot forming and/or warm forming). In certain aspects, the optimized microstructure provides aluminum alloys that can be heated to a hot forming temperature and subsequently hot formed without extended soaking periods at the hot forming temperature. For example, aluminum alloys provided in a comparative F temper are heated to a hot forming temperature (e.g., about 480° C.) and are soaked at the hot forming temperature for about 60 seconds. Conversely, aluminum alloys processed according to the methods described herein, provided in the F* temper, for example, can be heated to a hot forming temperature and subsequently hot formed for a period shorter than 60 seconds (e.g., 30 seconds or less, 20 seconds or less, 15 seconds or less, 10 seconds or less, or 5 seconds or less) or without any soaking, which is referred to herein as a flash heating to forming step).

In some non-limiting examples, providing the aluminum alloy in the F* temper and performing the flash heating to forming step can provide an aluminum alloy exhibiting surprising mechanical properties. For example, providing the aluminum alloy according to the methods described herein can provide an aluminum alloy having increased yield strength when compared to an aluminum alloy provided in F temper and heated to the hot forming temperature and soaked before forming. In certain aspects, the yield strength can be increased by up to about 400 MPa. For example, the yield strength can be increased by about 50 MPa, about 60 MPa, about 70 MPa, about 80 MPa, about 90 MPa, about 100 MPa, about 110 MPa, about 120 MPa, about 130 MPa, about 140 MPa, about 150 MPa, about 160 MPa, about 170 MPa, about 180 MPa, about 190 MPa, about 200 MPa, about 210 MPa, about 220 MPa, about 230 MPa, about 240 MPa, about 250 MPa, about 260 MPa, about 270 MPa, about 280 MPa, about 290 MPa, about 300 MPa, about 310 MPa, about 320 MPa, about 330 MPa, about 340 MPa, about 350 MPa, about 360 MPa, about 370 MPa, about 380 MPa, about 390 MPa, or about 400 MPa.

In some non-limiting examples, beginning the quenching step when the aluminum alloy is at a temperature greater than the solutionizing temperature (i.e., the solvus temperature) and performed at a sufficient rate (e.g., from about 10° C./second (° C./s) to about 1000° C./s) can provide an aluminum alloy in the W temper.

Downstream Processing Steps: Forming

The aluminum alloy product (e.g., the aluminum alloy hot band or the thin gauge aluminum alloy product) can be subjected to a forming process. The aluminum alloy product being subjected to the forming process can be called a "starting product" or a "starting material." In some examples, the starting material for the forming process includes the aluminum alloy hot band, the thin gauge aluminum alloy product, tubes, pipes, profiles, and others provided in an F* temper or a W temper. The forming process can be used on any heat treatable aluminum alloy product. An aluminum alloy product that can be used as a starting material in the described processes can be produced in a planar form at a desired gauge, for example, at a gauge suitable for production of motor vehicle parts.

The aluminum alloy coil can be unrolled or flattened prior to performance of the described processes. In some examples, a product may be pre-formed or subjected to other procedures, processes, and steps prior to forming according to the described processes. For example, the aluminum alloy hot band or the thin gauge aluminum alloy product may be sectioned by cutting into precursor aluminum alloy products or forms termed "blanks," such as "stamping blanks," meaning precursors for stamping. Blanks or stamping blanks are included among the products that can be treated according to the described processes. Optionally, a product can be post-formed or subjected to other procedures, processes, and steps after forming according to the described processes.

A product can formed into a final shape using one or more forming steps. A product may be subjected to post-forming heat treatment or coating after the described processes. In another example, a product may be aged to increase its strength. The aluminum alloy products produced in the course of performing the described processes, which can be referred to as shaped products, are included within the scope of the present disclosure.

Shaping the aluminum alloy products described herein involves heating the aluminum alloy product and optionally maintaining the product at that temperature for a period of time. Heating temperatures, heating rates, and/or their ranges are referred to as "heating parameters." In a hot forming process, the aluminum alloy products can be heated to a temperature of from about 400° C. to about 580° C., from about 410° C. to about 570° C., from about 420° C. to about 560° C., from about 430° C. to about 550° C., from about 440° C. to about 540° C., from about 450° C. to about 530° C., from about 460° C. to about 520° C., from about 480° C. to about 510° C., or from about 490° C. to about 500° C. For example, the aluminum alloy products can be heated to a temperature of about 400° C., about 410° C., about 420° C., about 430° C., about 440° C., about 450° C., about 460° C., about 470° C., about 480° C., about 490° C., about 500° C., about 510° C., about 520° C., about 530° C., about 540° C., about 550° C., about 560° C., about 570° C., or about 580° C.

The aluminum alloy products can be heated at a heating rate of from about 3° C./s to about 90° C./s, from about 10° C./s to about 90° C./s, from about 20° C./s to about 90° C./s, from about 30° C./s to about 90° C./s, from about 40° C./s to about 90° C./s, from about 50° C./s to about 90° C./s, from about 60° C./s to about 90° C./s, from about 70° C./s to about 90° C./s, or from about 80° C./s to about 90° C./s. In some examples, a heating rate of about 90° C./s is employed. In other examples, a heating rate of about 3° C./s is employed. In some examples, a heating rate of about 3° C./s to about 100° C./s, about 3° C./s to about 110° C./s, about 3° C./s to about 120° C./s, about 3° C./s to about 150° C./s, about 3° C./s to about 160° C./s, about 3° C./s to about 170° C./s, about 3° C./s to about 180° C./s, about 3° C./s to about 190° C./s, or about 3° C./s to about 200° C./s may be employed. In other examples, a heating rate of about 90° C./s to about 150° C./s may be employed. In other examples, a heating rate of about 200° C./s to about 600° C./s may be employed. For example, a heating rate of about 200° C./s, about 250° C./s, about 300° C./s, about 350° C./s, about 400° C./s, about 450° C./s, about 500° C./s, about 550° C./s, or about 600° C./s may be employed. One of ordinary skill in the art may adjust the heating rate with available equipment depending on the desired properties of the sheet or other product.

Various heating parameters can be employed in the heating processes. In one example, a heating rate of about 90° C./s to a temperature of from about 400° C. to about 580° C. is employed. In another example, a heating rate of about 90° C./s to a temperature of from about 410° C. to about 550° C. is employed. In yet another example, a heating rate of about 90° C./s to a temperature of from about 420° C. to about 525° C. is employed. In another example, a heating rate of about 3° C./s to a temperature of from about 400° C. to about 580° C. is employed. In another example, a heating rate of about 3° C./s to a temperature of from about 420° C. to about 525° C. is employed. These examples are provided for exemplary purposes only, rather than limiting the different temperatures and heating rates otherwise described herein.

Additionally, in a warm forming process, the aluminum alloy products can be heated to a temperature of from about 250° C. to about 400° C., from about 260° C. to about 390° C., from about 270° C. to about 380° C., from about 280° C. to about 370° C., from about 270° C. to about 360° C., from about 280° C. to about 350° C., from about 290° C. to about 340° C., from about 300° C. to about 330° C., or from about 310° C. to about 320° C. For example, the aluminum alloy products can be heated to a temperature of about 250° C., about 260° C., about 270° C., about 280° C., about 290° C., about 300° C., about 310° C., about 320° C., about 330° C., about 340° C., about 350° C., about 360° C., about 370° C., about 380° C., about 390° C., or about 400° C.

The heating parameters are selected based on a variety of factors, such as a desired combination of the properties of the aluminum alloy or aluminum alloy products. The above temperatures and temperature ranges are used to denote "heated to" temperature. In the described processes, the heating process is applied to a product (e.g., a sheet) until the "heated to" temperature is achieved. In other words, the "heated to" temperature is the temperature to which the aluminum alloy products are heated prior to the forming step. The "heated to" temperature may be maintained during the forming step by an appropriate heating process, or the heating process may be stopped before the forming step, in which case the temperature of the aluminum alloy products during the forming step may be lower than the specified "heated to" temperature. The temperature of the aluminum alloy products may or may not be monitored by appropriate procedures and instruments. For example, if the temperature is not monitored, the "heated to" temperature may be a calculated temperature and/or an experimentally deduced temperature.

The heating rate can be achieved by choosing an appropriate heat treatment, heating process, or system to heat the aluminum alloy products. Generally, the heating process or system employed should deliver sufficient energy to achieve the above-specified heating rates. For example, the heating can be accomplished by induction heating. Some other non-limiting examples of heating processes that can be employed are contact heating, resistance heating, infrared radiation heating, heating by gas burner, and direct resistive heating. Generally, design and optimization of the heating system and protocol may be performed to manage heat flow and/or to achieve the desired characteristics of the aluminum alloy products.

The aluminum alloy product can be maintained at the temperature of from about 400° C. to about 580° C. (i.e., soaked) for a period of about 5 minutes or less (e.g., about 4 minutes or less, about 3 minutes or less, about 2 minutes or less, about 1 minute or less, about 30 seconds or less, or about 10 seconds or less) in a hot forming process. In some cases, the aluminum alloy product can be soaked at a temperature of from about 250° C. to less than about 400° C. for a period of about 5 minutes or less (e.g., about 4 minutes or less, about 3 minutes or less, about 2 minutes or less, about 1 minute or less, about 30 seconds or less, or about 10 seconds or less) in a warm forming process. Optionally, the soaking step is not performed (e.g., a flash heating step as described above is performed). In certain aspects, the soaking step is performed at a time sufficient to not affect the strength of the aluminum alloy (e.g., no artificial aging occurs).

The heating and maintaining steps for the hot forming, as described herein, are referred to as a cycle time. The cycle time for the forming is at least 20% shorter than a cycle time needed for hot forming an aluminum alloy product prepared according to a method other than the method described herein (i.e., a method that does not include quenching the rolled product after the hot rolling step). In some cases, the cycle time is at least 30%, at least 40%, at least 50%, at least 60%, at least 70%, at least 80%, or at least 90% shorter than a cycle time needed for hot forming an aluminum alloy product prepared according to a method that does not include quenching the rolled product after the hot rolling step. The forming, as described above, can then be performed.

In certain aspects, the methods of forming described herein (e.g., hot forming and/or warm forming) and/or subsequent thermal processing (e.g., paint baking, post-forming heat treatment, annealing, or any other suitable heat treatment) can provide the aluminum alloy in a T4, T5, T6, T8, or T9 temper. Additionally, the methods described herein can provide aluminum alloys devoid of dispersoids. For example, quenching the aluminum alloy immediately after hot rolling (e.g., DC route as described above) and/or quenching the aluminum alloy during hot rolling (e.g., CC route as described above) provides insufficient time for the aluminum alloy to dwell at an elevated temperature for dispersoid forming elements to precipitate within the aluminum matrix and form dispersoids. For example, Ti, Sc, Zr, Cr, V, Hf, and/or Er present in the aluminum alloy can be frozen in a solutionized state by quenching immediately after hot rolling and/or quenching during hot rolling. In some cases, Ti, Sc, Zr, Cr, V, Hf, and/or Er are not present in the aluminum alloys described herein, further prohibiting dispersoid formation.

Methods of Use

The disclosed aluminum alloy products provided in the tempers described herein may be incorporated into existing processes and lines for production of aluminum alloy products, such as hot formed aluminum products (for example, hot formed automotive structural members), thereby improving the processes and the resulting products in a streamlined and economical manner. The systems and methods for performing the forming processes and producing the products described herein are included within the scope of the disclosure.

The described processes can be advantageously employed in the transportation industry, including, but not limited to, automotive manufacturing, truck manufacturing, manufacturing of ships and boats, manufacturing of trains, airplanes and spacecraft manufacturing. Some non-limiting examples of the automotive parts include floor panels, rear walls, rockers, motor hoods, fenders, roofs, door panels, B-pillars, body sides, rockers, or crash members. The term "automotive" and the related terms as used herein are not limited to automobiles and include various vehicle classes, such as, automobiles, cars, buses, motorcycles, marine vehicles, off highway vehicles, light trucks, trucks, or lorries. However, aluminum alloy products are not limited to automotive parts; other types of aluminum products manufactured according to the processes described in this application are envisioned. For example, the described processes can advantageously be employed in the manufacturing of various parts of mechanical and other devices or machinery, including weapons, tools, bodies of electronic devices, and other parts and devices.

Illustrations of Suitable Methods and Products

Illustration 1 is a method of producing an aluminum alloy product comprising casting a heat treatable aluminum alloy to form a cast aluminum alloy; homogenizing the cast aluminum alloy; hot rolling the cast aluminum alloy to produce a rolled product; quenching the rolled product at a quench rate of from about 10° C./s to about 1000° C./s; and coiling the rolled product to provide an aluminum alloy product.

Illustration 2 is the method of any preceding or subsequent illustration, wherein the quench rate is from about 200° C./s to about 1000° C./s.

Illustration 3 is the method of any preceding or subsequent illustration, wherein the quench rate is from about 500° C./s to about 1000° C./s.

Illustration 4 is the method of any preceding or subsequent illustration, wherein the quenching is performed immediately after hot rolling the cast aluminum alloy.

Illustration 5 is the method of any preceding or subsequent illustration, wherein the quenching is performed using air, water, oil, a water-oil emulsion, or any combination thereof.

Illustration 6 is the method of any preceding or subsequent illustration, further comprising cold rolling the rolled product after the quenching.

Illustration 7 is the method of any preceding or subsequent illustration, wherein an annealing step is not performed.

Illustration 8 is the method of any preceding or subsequent illustration, wherein the heat treatable aluminum alloy comprises a 2xxx series aluminum alloy, a 6xxx series aluminum alloy, a 7xxx series aluminum alloy, or an 8xxx series aluminum alloy.

Illustration 9 is the method of any preceding or subsequent illustration, wherein the aluminum alloy product comprises a monolithic aluminum alloy product or a clad aluminum alloy product.

Illustration 10 is the method of any preceding or subsequent illustration, further comprising heating the aluminum alloy product to a temperature of from about 400° C. to about 580° C. and maintaining the aluminum alloy product at the temperature for about 5 minutes or less.

Illustration 11 is the method of any preceding or subsequent illustration, wherein the maintaining is performed for about 3 minutes or less.

Illustration 12 is the method of any preceding or subsequent illustration, wherein the maintaining is performed for about 1 minute or less.

Illustration 13 is the method of any preceding or subsequent illustration, wherein the maintaining is performed for about 30 seconds or less.

Illustration 14 is the method of any preceding or subsequent illustration, wherein a cycle time for performing the heating and the maintaining is at least about 20% shorter than a cycle time for an aluminum alloy product prepared without quenching the rolled product after the hot rolling step.

Illustration 15 is the method of any preceding or subsequent illustration, wherein the cycle time for performing the heating and the maintaining is at least about 30% shorter than a cycle time for an aluminum alloy product prepared without quenching the rolled product after the hot rolling step.

Illustration 16 is the method of any preceding or subsequent illustration, wherein the cycle time for performing the heating and the maintaining is at least about 40% shorter than a cycle time for an aluminum alloy product prepared without quenching the rolled product after the hot rolling step.

Illustration 17 is the method of any preceding or subsequent illustration, wherein the cycle time for performing the heating and the maintaining is at least about 50% shorter than a cycle time for an aluminum alloy product prepared without quenching the rolled product after the hot rolling step.

Illustration 18 is the method of any preceding or subsequent illustration, further comprising forming the aluminum alloy product after the maintaining at a temperature of from about 400° C. to about 580° C.

Illustration 19 is an aluminum alloy hot band prepared according to a method comprising casting a heat treatable aluminum alloy to form a cast aluminum alloy; homogenizing the cast aluminum alloy; hot rolling the cast aluminum alloy to produce a rolled product; quenching the rolled product at a quench rate of from about 10° C./s to about 1000° C./s; and coiling the rolled product to provide an aluminum alloy hot band.

Illustration 20 is the aluminum alloy product of any preceding illustration, wherein the aluminum alloy hot band is quenched immediately after the hot rolling.

Illustration 21 is a method of producing an aluminum alloy product comprising casting a heat treatable aluminum alloy to form a cast aluminum alloy; optionally heating the cast aluminum alloy; hot rolling the cast aluminum alloy to produce a rolled product, wherein the hot rolling is performed in a hot rolling mill comprising a plurality of stands, wherein each stand is followed by a quenching system;

quenching the rolled product upon exit from at least one stand in the plurality of stands in the hot rolling step at a quench rate of from about 10° C./s to about 1000° C./s; optionally cold rolling the rolled product; and coiling the rolled product to provide an aluminum alloy product.

Illustration 22 is an aluminum alloy product prepared according to the method of any preceding or subsequent illustration, wherein the aluminum alloy product comprises a sheet.

The following examples will serve to further illustrate the present invention without, at the same time, however, constituting any limitation thereof. On the contrary, it is to be clearly understood that resort may be had to various embodiments, modifications, and equivalents thereof which, after reading the description herein, may suggest themselves to those skilled in the art without departing from the spirit of the invention.

EXAMPLES

Example 1: Processing Method

FIG. 1 is a graph showing a thermal history of a comparative processing method described above. An aluminum alloy is heated in a heating step 110 to a hot rolling temperature 120 and allowed to soak for a period of time 130. The aluminum alloy is then hot rolled in a hot rolling step 140 and allowed to cool in a cooling step 150, thus providing the aluminum alloy in an F temper. Optionally, a cold rolling step 160 is employed to further reduce the gauge of the aluminum alloy. After production (time range A), the aluminum alloy in F temper is delivered to an end user, wherein the aluminum alloy can undergo further processing steps (time range B), including, for example, hot forming.

In a comparative method of hot forming an aluminum alloy, the aluminum alloy is heated in a heating step 170 to a temperature greater than or equal to a hot forming temperature, for example, from about 460° C. to about 480° C. The aluminum alloy is then soaked for a period of time 180 (e.g., from about 5 minutes to about 15 minutes) and subsequently hot formed in a hot forming step 190. In some cases, after being soaked for a period of time 180 the aluminum alloy is cooled to the hot forming temperature, thereby requiring a longer processing time.

Figure 2:
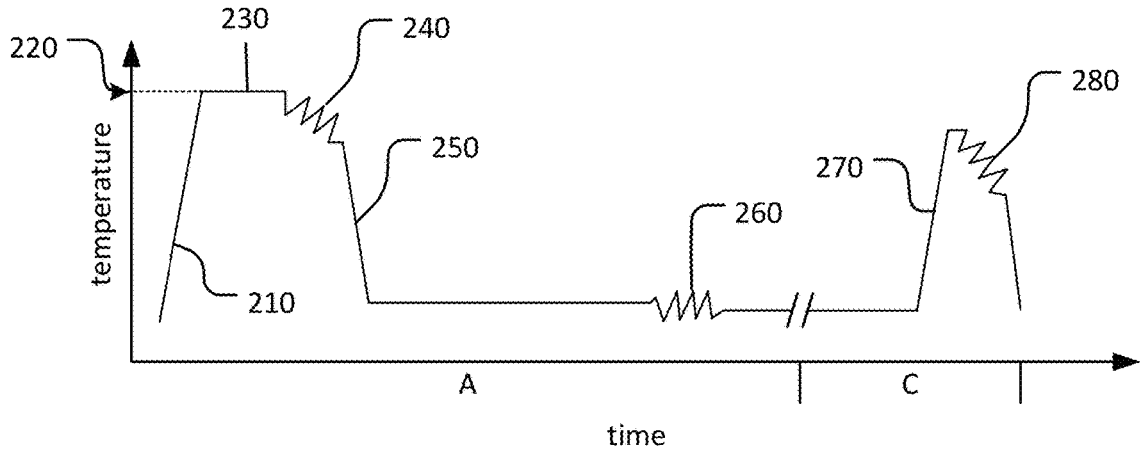
FIG. 2 is a graph showing thermal histories of an aluminum alloy processing method described herein.

FIG. 2 is a graph showing a thermal history of an exemplary processing method described above. An aluminum alloy is heated in a heating step 210 to a hot rolling temperature 220 and allowed to soak for a period of time 230. The aluminum alloy is then hot rolled in a hot rolling step 240 and quenched in a quenching step 250, thus providing the aluminum alloy in an F* temper. A cold rolling step 260 is optionally employed to further reduce the gauge of the aluminum alloy. After production (time range A), the aluminum alloy in the F* temper is delivered to an end user, wherein the aluminum alloy can undergo further processing steps (time range C), including, for example, hot forming. Delivering the aluminum alloy in the F* temper further provides abbreviated end user processing requirements, including time and energy.

In a method of hot forming an aluminum alloy in the exemplary F* temper, the aluminum alloy is heated in a heating step 270 to a temperature about equal to a hot forming temperature, for example, from about 400° C. to about 450° C. Accordingly, the aluminum alloy in the exemplary F* temper does not require any soaking time and can be immediately hot formed in a hot forming step 280. Thus, providing an aluminum alloy in the exemplary F* temper eliminates any need to heat the aluminum alloy to a temperature greater than the hot forming temperature, soak the aluminum alloy at the temperature greater than the hot forming temperature, and/or cool the aluminum alloy to the hot forming temperature if the aluminum alloy required heating to a temperature greater than the hot forming temperature.

Example 2: Laboratory Trials

A 7xxx series aluminum alloy (AA7075) was prepared according to the methods described above, including casting, homogenizing, and hot rolling to provide an aluminum alloy hot band having a gauge of 10.5 mm. Samples were taken from the aluminum alloy hot band (i.e., the hot band samples) and further processed to evaluate the methods described herein. The hot band samples were further processed according to three different processing routes: (a) a processing route to simulate full-scale production of the aluminum alloy in the F* temper described herein, referred to as "Route A;" (b) a processing route including further hot rolling to a final gauge (e.g., 2 millimeters (mm)), referred to as "Route B;" and (c) a comparative route including cold rolling to the final gauge after hot rolling, referred to as "Route C."

Figure 3:
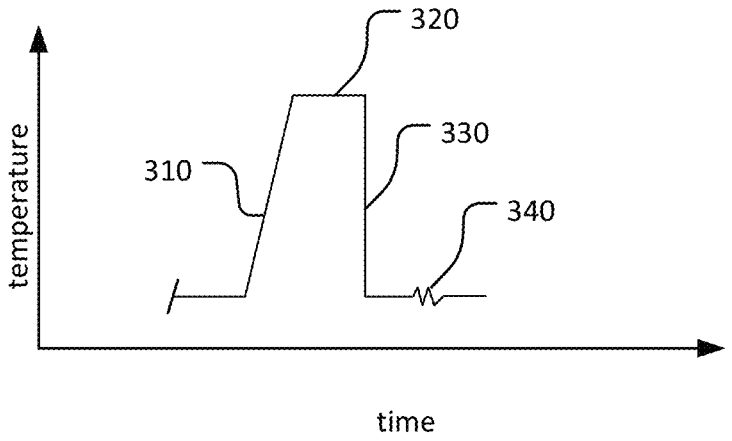
FIG. 3 is a graph showing thermal histories of an aluminum alloy processing method described herein.

Route A, simulating the processing to the F* temper, included further hot rolling in the laboratory to return the hot band sample to a post-hot rolling metallurgical state. The hot band sample was then solutionized at a temperature of 480° C. for 30 minutes, quenched with water, and immediately cold rolled to the final gauge, providing the sample in an intermediate W temper. FIG. 3 is a graph showing the thermal history of the sample processed according to Route A. The hot band sample was heated in a heating step 310 to a solutionizing temperature 320 (e.g., 480° C.) and maintained for 30 minutes, followed by quenching in a quenching step 330. The hot band sample was then cold rolled in a cold rolling step 340 to the final gauge (i.e., a sheet gauge).

Figure 4:
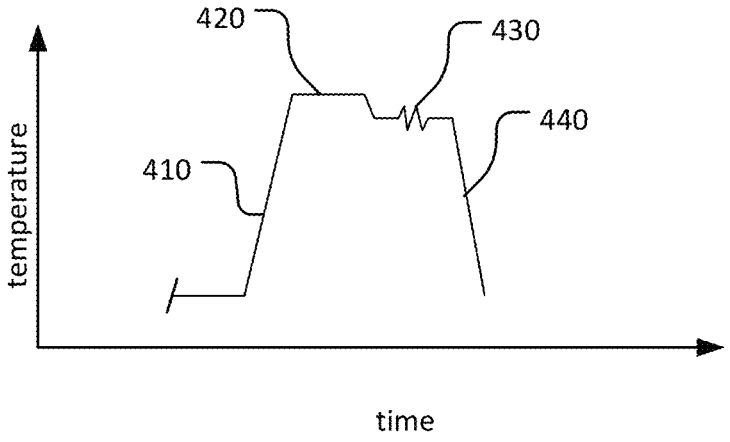
FIG. 4 is a graph showing thermal histories of an aluminum alloy processing method described herein.

Route B, simulating hot rolling the aluminum alloy hot band to the final gauge, included hot rolling in the laboratory to return the hot band sample to a post-hot rolling metallurgical state, solutionizing at a temperature of 480° C. for 30 minutes, and further hot rolling to achieve the final gauge. FIG. 4 is a graph showing the thermal history of the sample processed according to Route B. The hot band sample was heated in a heating step 410 to a solutionizing temperature 420 (e.g., 480° C.) and maintained for 30 minutes, followed by hot rolling in a hot rolling step 430 and quenching with air in an air quenching step 440.

Route C included cold rolling the hot band sample to the final gauge. Route C is a comparative method for processing an aluminum alloy sample that illustrates the benefit of employing the methods described herein.

The final gauges for the products from Routes A, B, and C were the same. After achieving the final gauge, each sample was subjected to various solutionizing processes to simulate the hot forming processes described above. The solutionizing processes included (i) heating the sample to 420° C. at a rate of about 20° C./s and immediately quenching; (ii) heating the sample to 460° C. at a rate of about 22° C./s and immediately quenching; (iii) heating the sample to 480° C. at a rate of about 23° C./s and immediately quenching; and (iv) heating the sample to 480° C. at a rate of about 23° C./s and maintaining this temperature for 60 seconds, followed by quenching. Solutionizing process (iv) was employed as a comparative process in which hot forming was performed at a temperature greater than hot forming temperatures required for aluminum alloys in the F* temper described herein (e.g., hot forming can be performed by heating the aluminum alloys to up to about 460° C. instead of at least about 480° C.). Additionally, solutionizing process (iv) included maintaining the solutionizing temperature for 60 seconds (i.e., soaking) which is required for aluminum alloys processed according to standard methods.

Figure 5:
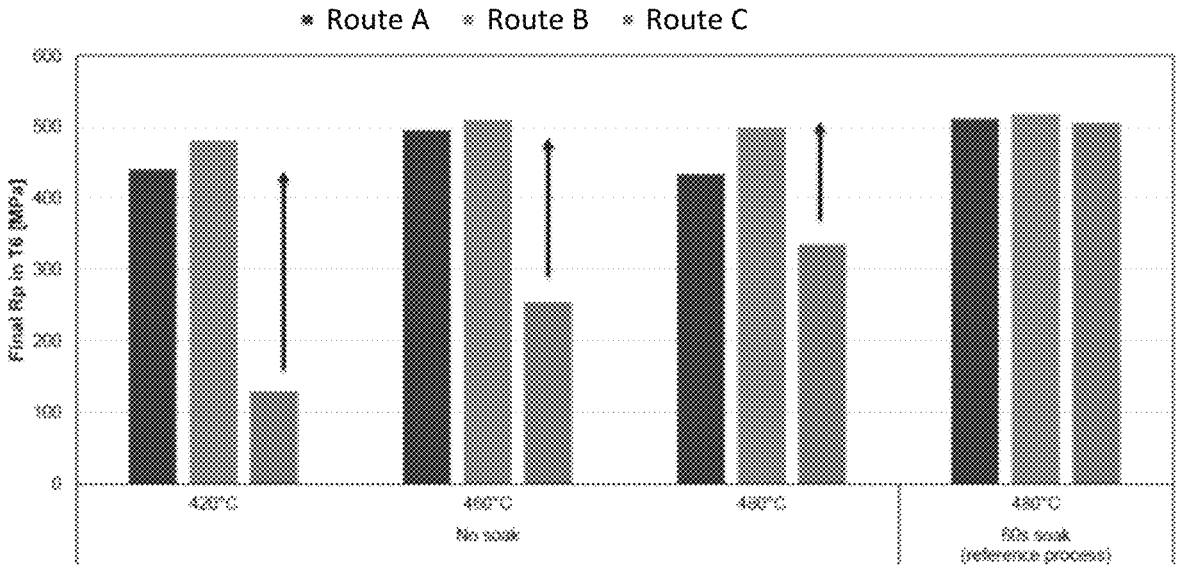
FIG. 5 is a graph showing yield strengths of aluminum alloys processed according to a comparative method and according to methods described herein.

After simulating the hot forming processes via solutionizing, the samples were artificially aged to a T6 temper by heating to 120° C. and maintaining this temperature for 24 hours. FIG. 5 is a graph showing the effect of processing the aluminum alloys according to the methods described herein on the yield strength in T6 temper (referred to as "Final Rp in T6 [MPa]"). Samples processed according to Route A (left histogram in each group), Route B (center histogram in each group), and Route C (right histogram in each group) were subjected to the various simulated hot forming processes and evaluated via tensile testing. As shown in FIG. 5, the samples processed according to the methods described herein and subjected to simulated hot forming processes at temperatures of up to 480° C. exhibited greater yield strengths than the samples processed according to the comparative method (Route C). Thus, employing the methods described herein to provide an aluminum alloy in the F* temper can reduce costs associated with post-production processing (e.g., forming) without negatively affecting the mechanical properties of the aluminum alloys.

Additionally, the samples processed according to the methods described herein achieved yield strengths comparable to aluminum alloys prepared and processed according to standard T6 temper practice, wherein the aluminum alloys are heated to the hot forming temperature and maintained at that temperature for at least 60 seconds before forming, as shown in the right group of histograms in FIG. 5 (referred to as "480° C. 60 s soak (reference process)"). Thus, as described herein, providing aluminum alloys in the F* temper can allow an end user (e.g., an original equipment manufacturer) to hot form aluminum alloy parts at a reduced temperature and for a reduced time without sacrificing strength.

Example 3: Flash Heating Laboratory Trials

Figure 6:
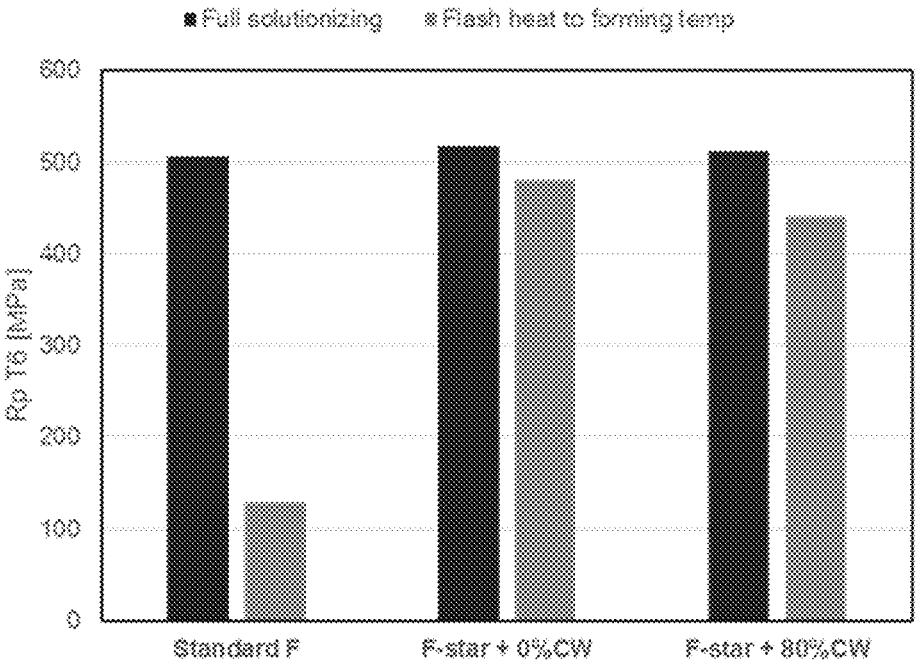
FIG. 6 is a graph showing yield strengths of aluminum alloys processed according to a comparative method and according to methods described herein.

Providing aluminum alloys in the F* temper provides aluminum alloys exhibiting an increased strength when compared to aluminum alloys provided in the F temper. Six aluminum alloy samples were prepared for tensile testing. A first pair of comparative aluminum alloy samples was provided in the F temper (referred to as "Standard F"), a second pair of aluminum alloy samples was provided in the F* temper (referred to as "F-star+0% CW"), and a third pair of aluminum alloy samples was provided in the F* temper and subjected to cold rolling to achieve an 80% gauge reduction (referred to as "F-star+80% CW"). For each pair of samples, a first sample was subjected to heating to the hot forming temperature and soaking for 60 seconds, and a second sample was subjected to flash heating by heating to 420° C. and not soaked before hot forming. All samples were subjected to a hot forming simulation step, performed by heating the samples to the hot forming temperature, soaking for a period of time that a deforming step would require (e.g., up to about 5 seconds, up to about 4 seconds, up to about 3 seconds, up to about 2 seconds, up to about 1 second, up to about 0.5 second, or anywhere in between), and quenching. The samples were then artificially aged to a final T6 temper according to the method described above. As shown in FIG. 6, all samples subjected to heating to the hot forming temperature and soaking (left histogram in each pair, referred to as "Full solutionizing") exhibited yield strengths between about 500 MPa and about 520 MPa. The samples subjected to the flash heating step (referred to as "Flash heat to forming temp") exhibited varying yield strengths. The comparative Standard F aluminum alloy sample exhibited a significantly lower yield strength of about 120 MPa after simulated forming. Surprisingly, the F-star+0% CW aluminum alloy sample exhibited a yield strength of about 470 MPa (e.g., about 350 MPa greater than the aluminum alloy in the F temper). Additionally, the F-star+80% CW aluminum alloy exhibited a greater yield strength than the Standard F aluminum alloy (e.g., about 430 MPa, or 310 MPa greater than the aluminum alloy in the F temper).

Figure 7:
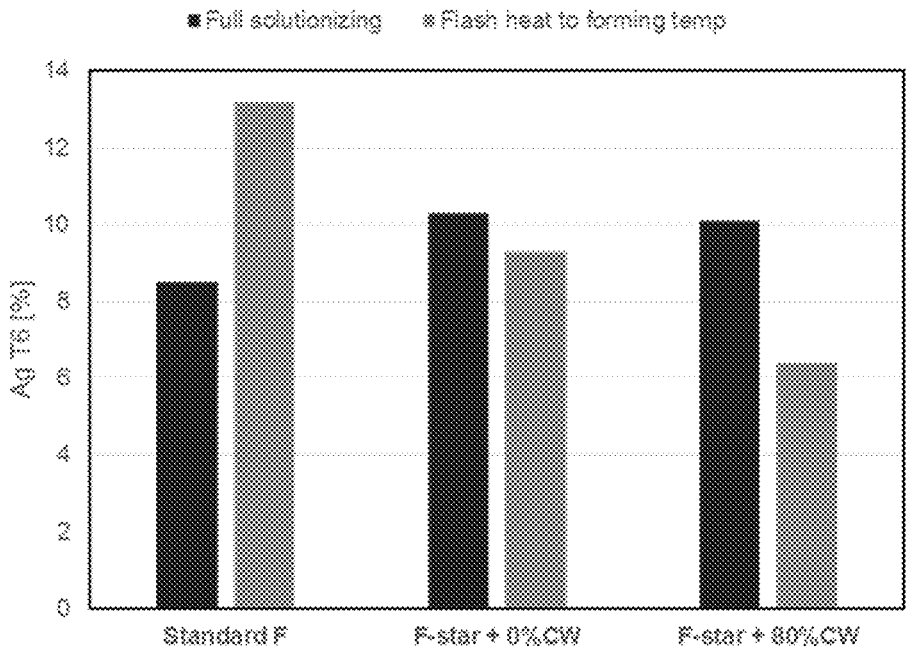
FIG. 7 is a graph showing elongations before fracture of aluminum alloys processed according to a comparative method and according to methods described herein.

The aluminum alloy samples in T6 temper described above (Standard F, F-star+0% CW, and F-star+80% CW) were also subjected to tensile testing to analyze elongation before fracture. As shown in FIG. 7, all samples subjected to heating to the hot forming temperature and soaking (left histogram in each pair, referred to as "Full solutionizing") exhibited comparable elongations before fracture ranging from about 8%-10%. The samples subjected to the flash heating step (referred to as "Flash heat to forming temp") exhibited varying elongation before fracture. The comparative Standard F aluminum alloy sample exhibited a significantly higher elongation before fracture after processing (e.g., about 13%). The F-star+0% CW aluminum alloy sample exhibited an elongation before fracture of about 9%, and the F-star+80% CW aluminum alloy sample exhibited an elongation before fracture of about 6%. Thus, providing the aluminum alloy in the F* temper can optimize a hot forming process and provide a high strength aluminum alloy with no significant loss of elongation before fracture.

Figure 8:
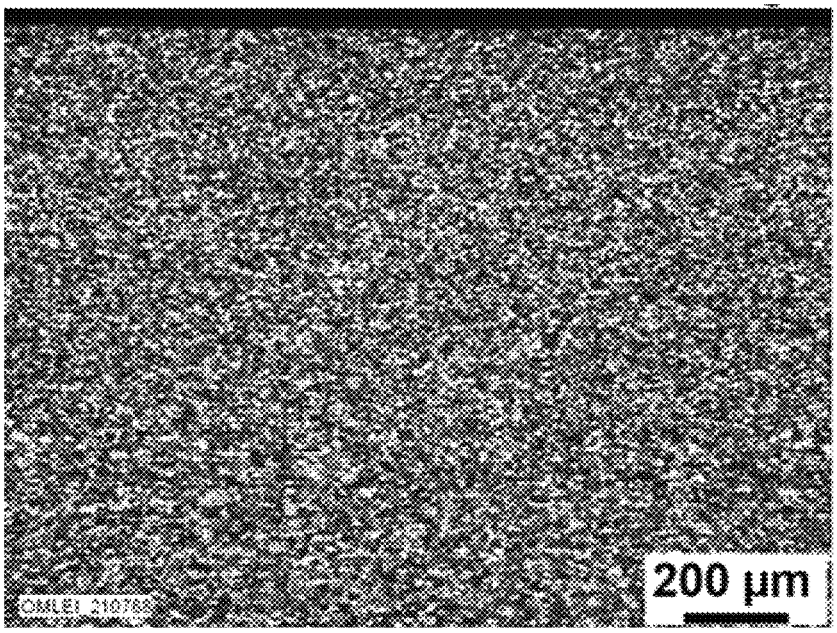
FIG. 8 is a micrograph showing the grain structure of an aluminum alloy processed according to a comparative method described herein.
Figure 9:
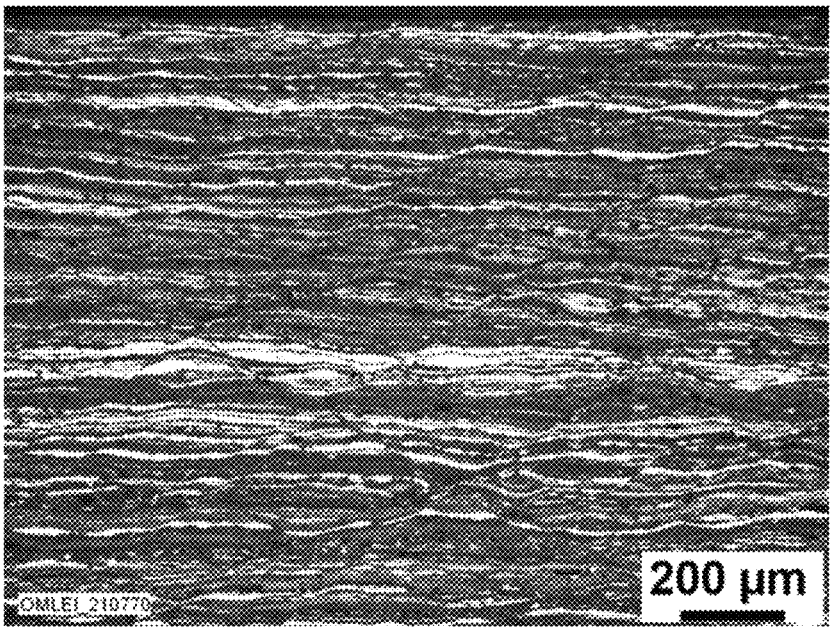
FIG. 9 is a micrograph showing the grain structure of an aluminum alloy processed according to methods described herein.
Figure 10:
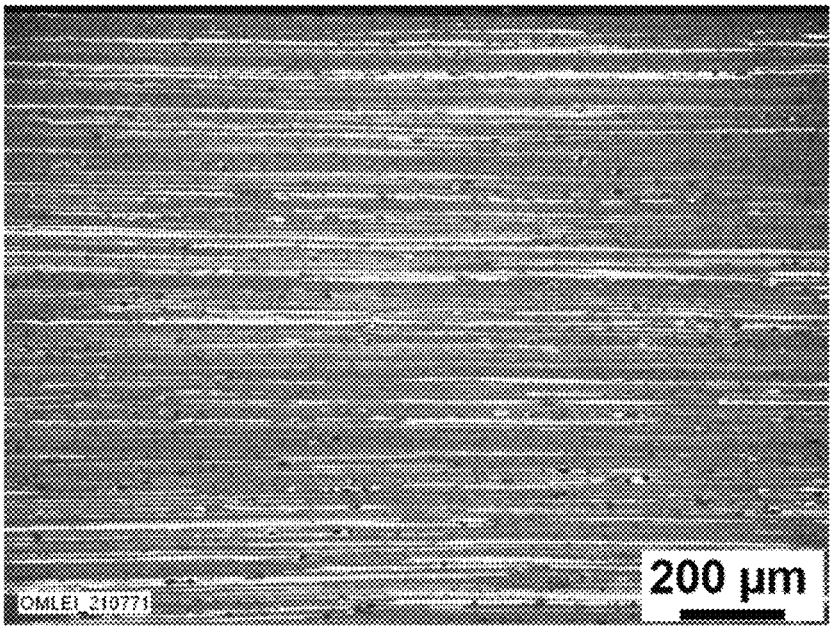
FIG. 10 is a micrograph showing the grain structure of an aluminum alloy processed according to methods described herein.

FIGS. 8-10 show varying grain structure provided by the methods described herein. The hot-formed aluminum alloy samples described above (Standard F, F-star+0% CW, and F-star+80% CW) were subjected to grain structure analysis. The comparative Standard F aluminum alloy exhibited a fine, equiaxial grain structure, as shown in FIG. 8. The F-star+0% CW aluminum alloy exhibited a fibrous grain structure with shear bands, as shown in FIG. 9. The F-star+80% CW aluminum alloy sample exhibited a fibrous grain structure, as shown in FIG. 10. The aluminum alloys provided in the F* temper (F-star+0% CW and F-star+80% CW), having the fibrous grain structure with shear bands and/or fibrous grain structure, did not crack during the hot forming step. Thus, the aluminum alloys provided in the F* temper are high strength aluminum alloys amenable to hot forming without heating to the hot forming temperature and soaking. The aluminum alloys as described herein can be subjected to an optimized hot forming process that beneficially can be performed in a reduced amount of time, resulting in reduced energy consumption and reduced costs.

All patents, publications, and abstracts cited above are incorporated herein by reference in their entireties. Various embodiments of the invention have been described in fulfillment of the various objectives of the invention. It should be recognized that these embodiments are merely illustrative of the principles of the present invention. Numerous modifications and adaptions thereof will be readily apparent to those skilled in the art without departing from the spirit and scope of the present invention as defined in the following claims.

What is claimed is:

1. A method of producing an aluminum alloy product comprising:

casting a heat treatable aluminum alloy to form a cast aluminum alloy;

heating the cast aluminum alloy;

hot rolling the cast aluminum alloy to produce a rolled product;

quenching the rolled product at a quench rate of from about 10° C./s to about 1000° C./s, wherein the quenching is performed during hot rolling the cast aluminum alloy;

coiling the rolled product to provide an aluminum alloy product, and preparing the aluminum alloy product for forming by heating the aluminum alloy product to a temperature of from 400° C. to 580° C. and maintaining the aluminum alloy product at the temperature for 5 minutes or less wherein the aluminum alloy product is in F* or W temper.

2. The method of claim 1, wherein the quench rate is from about 200° C./s to about 1000° C./s.

3. The method of claim 1, wherein the quench rate is from about 500° C./s to about 1000° C./s.

4. The method of claim 1, wherein the quenching is performed using air, water, oil, a water-oil emulsion, or any combination thereof.

5. The method of claim 1, further comprising cold rolling the rolled product after the quenching.

6. The method of claim 1, wherein an annealing step is not performed subsequent to a forming step.

7. The method of claim 1, wherein the heat treatable aluminum alloy comprises a 2xxx series aluminum alloy, a 6xxx series aluminum alloy, a 7xxx series aluminum alloy, or an 8xxx series aluminum alloy.

8. The method of claim 1, wherein the aluminum alloy product comprises a monolithic aluminum alloy product or a clad aluminum alloy product.

9. The method of claim 1, wherein the maintaining is performed for 3 minutes or less.

10. The method of claim 9, wherein the maintaining is performed for 1 minute or less.

11. The method of claim 10, wherein the maintaining is performed for 30 seconds or less.

12. The method of claim 1, wherein a cycle time for performing the heating and the maintaining is at least 20% shorter than an at least 15 minute cycle time for performing the heating and the maintaining for an aluminum alloy product prepared without quenching the rolled product after the hot rolling step.

13. The method of claim 12, wherein the cycle time for performing the heating and the maintaining is at least 50% shorter than an at least 15 minute cycle time for performing the heating and the maintaining for an aluminum alloy product prepared without quenching the rolled product after the hot rolling step.

14. The method of claim 1, further comprising forming the aluminum alloy product after the maintaining at a temperature of from 400° C. to 580° C.

15. A method of producing an aluminum alloy product comprising:

casting a heat treatable aluminum alloy to form a cast aluminum alloy;

optionally heating the cast aluminum alloy;

hot rolling the cast aluminum alloy to produce a rolled product, wherein the hot rolling is performed in a hot rolling mill comprising a plurality of stands, wherein each stand is followed by a quenching system;

quenching the rolled product upon exit from at least one stand in the plurality of stands in the hot rolling step at a quench rate of from about 10° C./s to about 1000° C./s, wherein the quenching is performed rolling the cast aluminum alloys;

optionally cold rolling the rolled product; and coiling the rolled product to provide an aluminum alloy product wherein the aluminum alloy product is in F* or W temper.

* * * * *